US007495166B2

(12) United States Patent
Yamada et al.

(10) Patent No.: US 7,495,166 B2
(45) Date of Patent: Feb. 24, 2009

(54) SOUND PROCESSING APPARATUS, SOUND PROCESSING METHOD, SOUND PROCESSING PROGRAM AND RECORDING MEDIUM WHICH RECORDS SOUND PROCESSING PROGRAM

(75) Inventors: Youichi Yamada, Tokorozawa (JP); Yuuji Murai, Tokorozawa (JP); Tatsuya Shiraishi, Tokorozawa (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 11/661,129

(22) PCT Filed: Aug. 23, 2005

(86) PCT No.: PCT/JP2005/015254

§ 371 (c)(1),
(2), (4) Date: Mar. 26, 2007

(87) PCT Pub. No.: WO2006/022248

PCT Pub. Date: Mar. 2, 2006

(65) Prior Publication Data

US 2007/0256544 A1 Nov. 8, 2007

(30) Foreign Application Priority Data

Aug. 25, 2004 (JP) ..... 2004-245512

(51) Int. Cl.
*G10H 1/04* (2006.01)
*G10H 5/00* (2006.01)

(52) U.S. Cl. ..... 84/624; 84/601; 84/609; 84/622; 84/659

(58) Field of Classification Search ..... None
See application file for complete search history.

(56) References Cited

U.S. PATENT DOCUMENTS

| | | | | |
|---|---|---|---|---|
| 5,373,098 | A * | 12/1994 | Kitayama et al. | 84/659 |
| 5,513,129 | A * | 4/1996 | Bolas et al. | 703/13 |
| 5,854,600 | A * | 12/1998 | Johnson et al. | 341/155 |
| 6,369,822 | B1 * | 4/2002 | Peevers et al. | 345/473 |
| 7,310,302 | B2 * | 12/2007 | Cimini et al. | 370/203 |

FOREIGN PATENT DOCUMENTS

| | | | |
|---|---|---|---|
| JP | 52-121315 | A | 10/1977 |
| JP | 5-11791 | A | 1/1993 |
| JP | 5-224685 | A | 9/1993 |
| JP | 5-323987 | A | 12/1993 |
| JP | 6-51791 | A | 2/1994 |
| JP | 6-259068 | A | 9/1994 |

(Continued)

*Primary Examiner*—Marlon T Fletcher
(74) *Attorney, Agent, or Firm*—Sughrue Mion, PLLC

(57) ABSTRACT

A sound-processing apparatus is provided that is capable of creating a sound effect without having to worry about changes in parameters such as the beat of the input sound source. The sound-processing apparatus comprises: a delay unit DB that generates at least one or more new synchronized sound signal that is synchronized with a sound signal Si to be modulated; parameter-detection unit 6 that detects a parameter that indicates an attribute of the generated synchronized sound signal; a signal-conversion unit 8 that generates a converted signal Sdm based on the detected parameter; and a modulation unit that modulates the sound signal based on the generated converted signal Sdm.

7 Claims, 12 Drawing Sheets

FOREIGN PATENT DOCUMENTS

| | | | |
|---|---|---|---|
| JP | 6-308950 | A | 11/1994 |
| JP | 6-332487 | A | 12/1994 |
| JP | 6-332488 | A | 12/1994 |
| JP | 7-36474 | A | 2/1995 |
| JP | 7-77982 | A | 3/1995 |
| JP | 7-129164 | A | 5/1995 |
| JP | 11-30991 | A | 2/1999 |
| JP | 2003-271144 | A | 9/2003 |

* cited by examiner

SOUND PROCESSING APPARATUS, SOUND PROCESSING METHOD, SOUND PROCESSING PROGRAM AND RECORDING MEDIUM WHICH RECORDS SOUND PROCESSING PROGRAM

TECHNICAL FIELD

The present invention relates to a sound-processing apparatus.

BACKGROUND ART

Machines called effecters that perform various processing on original input sound in order to change the sound are known. Of these effecters, various effecters are known, such as so-called modulation-type effecters, that by outputting the original sound after adding a sound, which is the result of giving a phase difference or a time difference to the original input sound, causes the output sound to vary and creates an effect that gives the listener a feel of spatial width and depth.

DISCLOSURE OF THE INVENTION

Problems to be Solved by the Invention

However, repeating of the sound effect created by the aforementioned effecter uses independent circuitry inside the effecter that is independent of the sound input to the effecter. Therefore, when the sound that is input to the effecter changes, the timing of the start of the sound effect by the effecter does not match the beat, such as the tempo or rhythm of the input sound, which creates an unneeded sound effect that is unpleasant or uncomfortable for the listener.

More specifically, in a dance hall where music from a CD (Compact Disc) or the like is played, by having a disc jockey use the effecter to generate sound effects, it is possible for the listeners to dance various steps to the music while listening to various stimulating sounds. However, when operations are performed to cause changes to the sound source, such as changing the tempo by changing the rpm of the CD, or changing the sound source, the sound effect from the effecter is generated at a timing that is unexpected by the listener. Therefore, the listener will have an unpleasant feeling, and the disk jockey must perform the tedious work of preparing for the next operation, such as selection of the next sound effect or change to the sound source, while at the same time checking by ear whether the timing of the beat, such as the tempo or rhythm of the sound, and that of the sound effect are out of phase.

Therefore, the object of the present invention is to provide a sound-processing apparatus that is capable of automatically generating sound effects that fit the sound source so that the user, such as a disc jockey, does not have to perform troublesome work.

Means for Solving the Problems

A sound-processing apparatus of this invention is provided with: a synchronized-sound-generation device for generating at least one or more new synchronized sound signal that is synchronized with a sound signal to be modulated; a parameter-detection device for detecting a parameter that indicates an attribute of the generated synchronized sound signal; a converted-signal-generation device for generating a converted signal based on the detected parameter; and a modulation device for modulating the sound signal based on the generated converted signal.

With this construction, the sound to be modulated is modulated in synchronization with the beat of the sound to be modulated and a sound effect is generated even when the interval between beats of the sound to be modulated is not fixed, or when the interval between beats of the sound to be modulated gradually becomes longer or shorter.

More specifically, with the construction described above, by making the timing at which a sound effect is added to a sound such as music that is generated by an information-reproduction apparatus such as a CD player constant, a sound effect is generated within a fixed amount of time after the beat is generated even when there are changes to the beat and rhythm of the sound such as music that is generated by an information-reproduction apparatus such as a CD player, so it is possible for listeners to enjoy a sound effect for sound such as music without feeling uncomfortable.

Also, since the sound effect is generated continuously without the listeners feeling uncomfortable, the disc jockey does not need to perform the tedious work of fine adjustment of the timing for generating the sound effect. Also, the disc jockey is able to concentrate on selecting the next information-recording medium such as a CD to be reproduced, or selecting the next the sound effect to generate, so it is possible to provide a sound-processing apparatus that has very good operability for the disc jockey.

Also, the sound-processing apparatus of this invention is further provided with: a time-difference-setting device used for setting a starting time difference between the sound to be modulated and the synchronized sound to be generated; wherein the synchronized-sound-generation device generates the synchronized sound having at least one or more time difference based on at least one or more time difference that is set by the time-difference-setting device.

With this construction, it is possible to generate a plurality of synchronized sounds that are synchronized with the beat of the sound to be modulated, and to generate a plurality of sound effects by modulation means based on a the plurality of synchronized sounds. As a result, it is possible to enjoy sound effects having various patterns for one beat.

Moreover, in addition to being able to set a time difference by inputting the value of the time difference, it is possible to automatically set a time difference from the beat of the sound to be modulated by having the disc jockey tap out and input a beat by hand. In this case, it is possible for the disc jockey to generate a sound effect extemporaneously according to his/her own sense. Furthermore, this sound-processing apparatus is capable of generating various sound effects that fit the atmosphere of the location or a sound that is output from an information-reproduction apparatus such as a CD player, and that correspond to the beat of the sound to be modulated, so it is possible for listeners to enjoy stimulating sound effects that correspond to the beat of the sound to be modulated.

Moreover, since it is not necessary for the disc jockey to worry about the sound effect becoming out of phase from the beat, it is possible for the disc jockey to have more time to prepare for generating the next sound effect or selecting the next sound to be played.

The sound-processing apparatus of this invention is, wherein the modulation device is provided with: a time-delay device for delaying the time of the sound to be modulated based on the detected sound level in order to generate a time-delayed signal; a gain-change device for changing the gain of the time-delayed signal for which the time is delayed; a first adding device for adding the time-delayed signal, for which the gain is changed, and the sound signal to be modulated, and then feeding back and inputting the added signal to the time-delay device; and a second adding device for adding the time-delayed signal, for which the time is delayed, and the sound signal to be modulated, and then outputting the added signal.

With this construction, it is possible to generate a sound effect that is synchronized with the beat of the sound to be modulated and that has one or more unique swelling effect. As a result, it is possible to enjoy a sound effect for a sound having various time differences for one beat.

Moreover, it is possible for the disc jockey to extemporaneously generate a sound effect according to his/her own sense by way of a delay-time-setting unit as an example of time-difference-setting means. Furthermore, since this sound-processing apparatus is capable of generating various sound effects that fit the atmosphere of the location or a sound that is output from an information-reproduction apparatus such as a CD player, and that correspond to the beat of the sound to be modulated, so it is possible for listeners to enjoy stimulating sound effects that correspond to the beat of the sound to be modulated.

Moreover, since it is not necessary for the disc jockey to worry about the sound effect becoming out of phase from the beat, it is possible for the disc jockey to have more time to prepare for generating the next sound effect or selecting the next sound to be played.

More specifically, conventionally, modulation was set based on the sound level of a simple triangular waveform or triangular type sine waveform, so it was only possible for the listeners to enjoy a sound effect according to modulation that based on a set pattern. However, with the construction of this form of the invention, the waveform of the sound to be modulated freely changes, so modulation is performed according to an unpredicted pattern, and it becomes possible for the user to enjoy sound effects having various patterns.

For example, it is possible for the disc jockey to use the sound-processing apparatus to generate various sound effects in a location such as a dance hall, so it is possible for the user to enjoy different kinds of dancing.

The sound-processing apparatus according of this invention is, wherein the modulation device is provided with: a phase-delay device for delaying the phase of the sound to be modulated based on the detected sound level in order to generate a phase-delayed signal; a gain-change device for changing the gain of the phase-delayed signal for which the phase is delayed; a first adding device for adding the phase-delayed signal, for which the gain is changed, and the sound signal to be modulated, and then feeding back and inputting the added signal to the phase-delay device; and a second adding device for adding the phase-delayed signal, for which the phase is delayed by the phase-delay device, and the sound signal to be modulated, and then outputting the added signal.

With this construction, it is possible to generate sound of which the high-frequency component having one or more unique swell is synchronized with the beat of the sound to be modulated. As a result, it is possible to enjoy a sound effect having various time differences for one beat.

Also, it is possible for the disc jockey to extemporaneously generate a sound effect according to his/her sense by way of a delay-time-setting unit. Moreover, this sound-processing apparatus is capable of generating a variety of sound effects that fit the atmosphere of the location and the sound that is output from an information-reproduction apparatus such as a CD player, and that correspond to the beat of the sound to be modulated, so it is possible for listeners to enjoy stimulating sound effects that correspond to the beat of the sound to be modulated.

Furthermore, since the disc jockey does not need to worry about the sound effect becoming out of phase from the beat, it is possible for the disc jockey to have more time to prepare for generating for the next sound effect or for selecting the next sound to be reproduced.

The sound-processing apparatus of this invention is, wherein the modulation unit is provided with: a specified-frequency-band-passing device having at least one or more cutoff frequencies and that changes the value of any one of the cutoff frequencies based on the detected sound level; and an adding device for adding the passed signal that passed through the specified-frequency-band-passing device and the sound signal to be modulated, then feeding back and inputting the added signal to the specified-frequency-band-passing device.

With this construction, it is possible to generate sound of which the high-frequency component having one or more unique swell is synchronized with the beat of the sound to be modulated. As a result, it is possible to enjoy a sound effect having various time differences for one beat.

Also, it is possible for the disc jockey to extemporaneously generate a sound effect according to his/her sense by way of the delay-time-setting means. Moreover, this sound-processing apparatus is capable of generating a variety of sound effects that fit the atmosphere of the location and the sound that is output from an information-reproduction apparatus such as a CD player, and that correspond to the beat of the sound to be modulated, so it is possible for listeners to enjoy stimulating sound effects that correspond to the beat of the sound to be modulated.

Furthermore, since the disc jockey does not need to worry about the sound effect becoming out of phase from the beat, it is possible for the disc jockey to have more time to prepare for generating for the next sound effect or for selecting the next sound to be reproduced.

A sound-processing method is provided with: a synchronized-sound-generation process of generating at least one or more new synchronized sound signal that is synchronized with a sound signal to be modulated; a parameter-detection process of detecting a parameter that indicates an attribute of the generated synchronized sound signal; a converted-signal-generation process of generating a converted signal based on the detected parameter; and a modulation process of modulating the sound signal based on the generated converted signal.

With this construction, when the interval between beats of the sound to be modulated is not fixed, or when the interval between beats of the sound to be modulated gradually becomes longer or shorter, the sound to be modulated is synchronized with the beat of the sound to be modulated and modulated, and a sound effect is generated.

More specifically, by fixing the timing of adding a sound effect to sound such as music that is reproduced by an information-reproduction apparatus such as a CD player with the construction described above, the sound effect is generated within a fixed time after the beat is generated even when there are changes in the beat and rhythm of the sound such as music that is reproduced by an information-reproduction apparatus such as a CD player, so it is possible for the listener to enjoy a sound effect to sound such as music without feeling uncomfortable.

Also, for a disc jockey, the sound effect is continuously generated without the listener feeling uncomfortable, so the disc jockey does not have to perform the tedious work of fine tuning the timing for generating the sound effect. Moreover, the disc jockey is able to concentrate more on selecting the next information-recording medium such as a CD to be reproduced, or selecting the next sound effect to be generated, so it possible to provide a sound-processing apparatus that has very good operability for the disc jockey.

A sound-processing program of this invention, that makes a computer included in a sound-processing apparatus that modulates a sound to be modulated function as: a synchronized-sound-generation device for generating at least one or more new synchronized sound signal that is synchronized with a sound signal to be modulated; a parameter-detection device for detecting a parameter that indicates an attribute of the generated synchronized sound signal; a converted-signal-generation device for generating a converted signal based on the detected parameter; and a modulation device for modulating the sound signal based on the generated converted signal.

With this construction, when the interval between beats of the sound to be modulated is not fixed, or when the interval between beats of the sound to be modulated gradually becomes longer or shorter, the sound to be modulated is synchronized with the beat of the sound to be modulated and modulated, and a sound effect is generated.

More specifically, by fixing the timing of adding a sound effect to sound such as music that is reproduced by an information-reproduction apparatus such as a CD player with the construction described above, the sound effect is generated within a fixed time after the beat is generated even when there are changes in the beat and rhythm of the sound such as music that is reproduced by an information-reproduction apparatus such as a CD player, so it is possible for the listener to enjoy a sound effect to sound such as music without feeling uncomfortable.

Also, for a disc jockey, the sound effect is continuously generated without the listener feeling uncomfortable, so the disc jockey does not have to perform the tedious work of fine tuning the timing for generating the sound effect. Moreover, the disc jockey is able to concentrate more on selecting the next information-recording medium such as a CD to be reproduced, or selecting the next sound effect to be generated, so it possible to provide a sound-processing apparatus that has very good operability for the disc jockey.

DESCRIPTION OF REFERENCE NUMERALS

Figure 1:
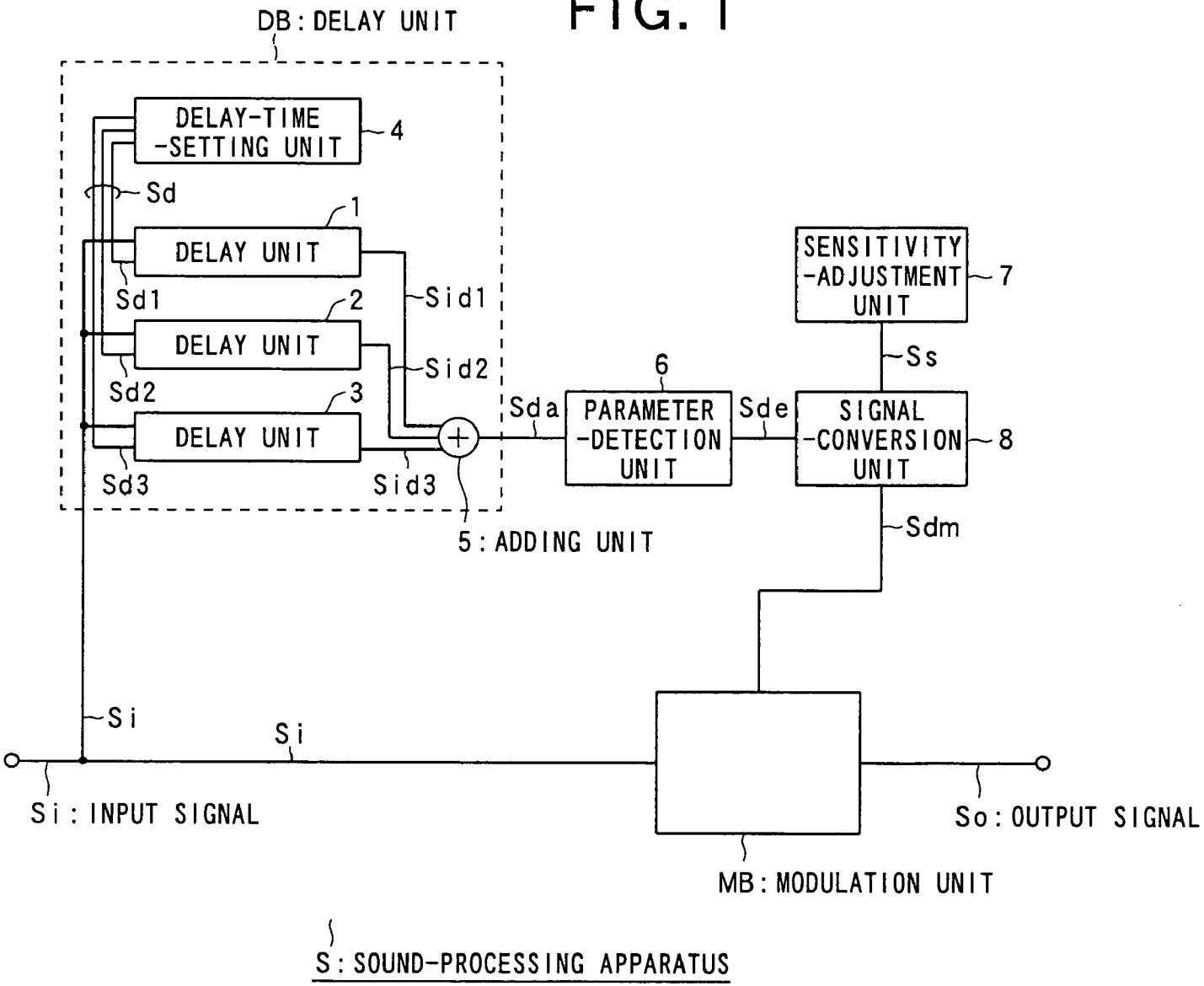
FIG. 1 is a block diagram showing the major construction of the sound-processing apparatus of the embodiments of the present invention.

1, 2, 3, 9 . . . Delay unit
5, 11, 13 . . . Adding unit
6 . . . Parameter-detection unit
7 . . . Sensitivity-adjustment unit
8 . . . Signal-conversion unit
10 . . . Resonance-setting unit
12 . . . Buffer unit
DB, DB1, DB2, DB3 . . . Delay unit
MB, MB1, MB2, MB3 . . . Modulation unit

BEST MODE FOR CARRYING OUT THE INVENTION

Next, the preferred embodiments of the present invention will be explained based on the drawings.

The embodiments described below, are embodiments in which the sound-processing apparatus of this invention is applied to a CD or DVD (Digital Versatile Disc) effecter in an entertainment facility, such as a dance hall or disco hall, and operated by a so-called disc jockey that performs work of playing various music while adding changes to amplified music in order that customers can dance and have fun.

Also, in this first embodiment, the case is explained in which the present invention is applied to an apparatus that combines a so-called tap-delay circuit that is capable of setting a plurality of delay times, and a so-called flanger that obtains a unique swelling sound effect by adding a slightly delayed sound to the input sound and changing that delay time. In the second embodiment, the case is explained in which the present invention is applied to an apparatus that combines a so-called tap-delay circuit and a so-called phaser that changes the phase of the sound in order to generate a sound effect that gives a feeling of rotation to the sound. In the third embodiment, the case in which the invention is applied to an apparatus that combines a so-called tap-delay circuit and a filter circuit that lets sound from part of the frequency bandwidth of the input sound pass while changing the sound.

(I) Overall Construction and Operation

Figure 2:
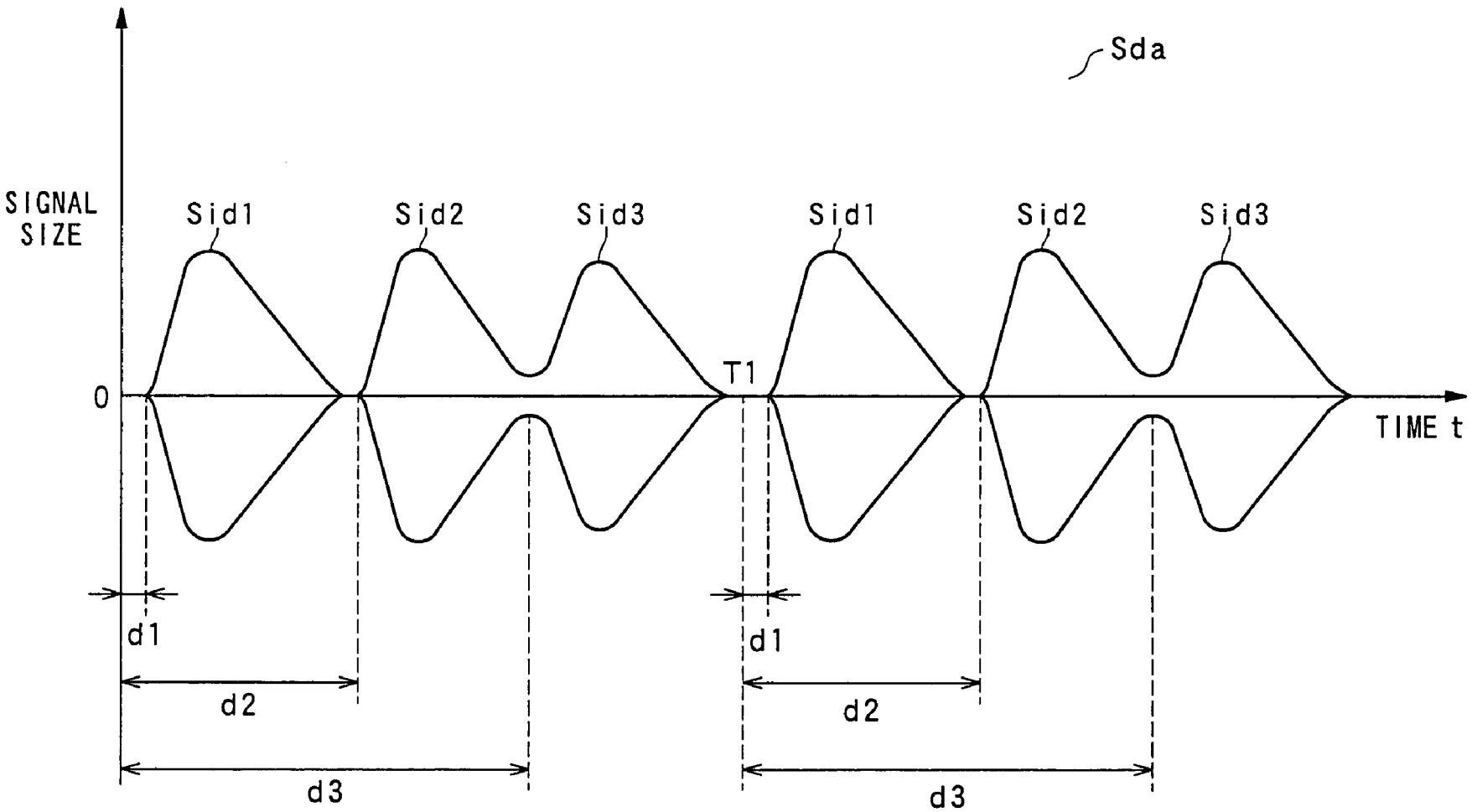
FIG. 2 is a drawing that graphically shows the waveform of an added signal Sda.
Figure 3:
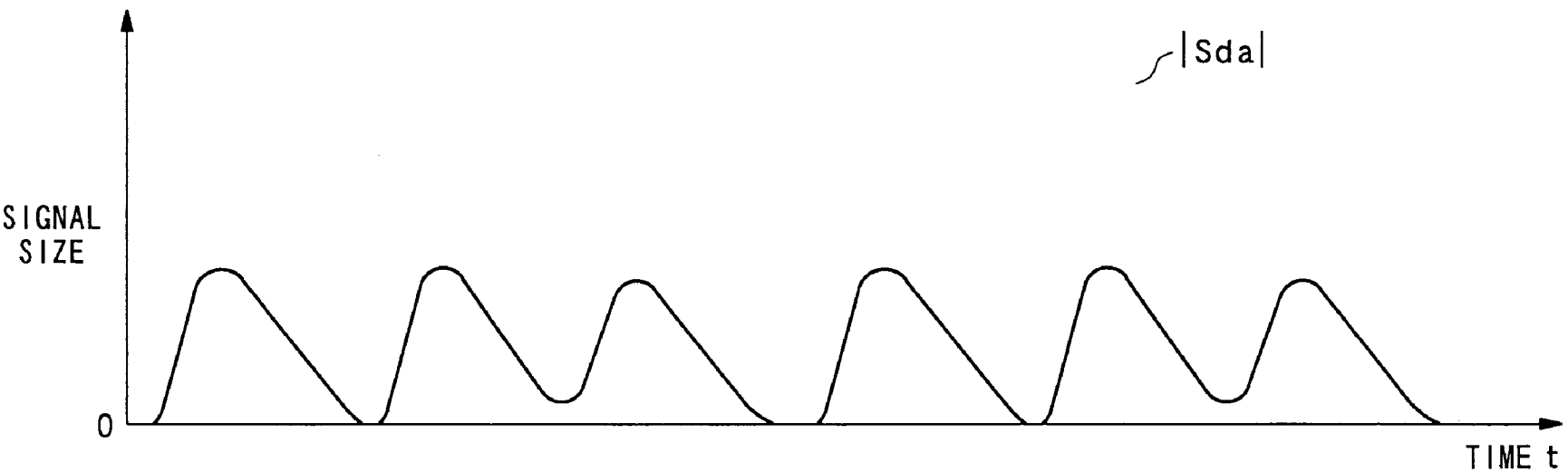
FIG. 3 is a drawing that graphically shows the waveform of a control signal Sdm.

First, the overall construction of the sound-processing apparatus of each of the embodiments will be explained using FIG. 1 to FIG. 3. FIG. 1 is a block diagram showing the major construction of the sound-processing apparatus of each of the embodiments. FIG. 2 is a drawing that graphically shows the waveform of an added signal Sda that will be described later, and FIG. 3 is a drawing that graphically shows the waveform of a control signal Sdm that will be described later.

As shown in FIG. 1 the sound-processing apparatus S of each of the embodiments is such that a sound signal, such as a playback signal of a CD, DVD or analog record is input as an input signal Si. After obtaining the input signal Si, the sound-processing apparatus S performs sound processing on the input signal Si to produce a specified sound effect. Also, the output signal So, which has been processed so that the sound has a specified sound effect, is amplified by the speakers of a speaker system (not shown in the figures) comprising a plurality of speakers, so that sound having a unique sound effect is provided to listeners, and provides a fun, stimulating and a unique rhythm to an acoustical space.

For example, in an entertainment facility such as a disco or dance hall, a disc jockey that performs creative sound effects on sound that is played back from a CD, DVD or analog record can use this sound-processing apparatus. In this case, the sound effect that is created by this sound-processing apparatus functions as a so-called effecter, and in an entertainment facility such as a disco or dance hall, sound having an even more unique sound effect is provided to those dancing to the music, and thus a more fun, stimulating and unique rhythm is provided to the acoustical space than was provided by a conventional effecter.

This sound-processing apparatus S comprises: delay units 1, 2, 3 that acquire an input signal Si by reproducing sound from a sound source such as a recording medium, or by obtaining sound from an external sound source such as a wired broadcast, and delay the input signal Si by just a predetermined time; a delay-time-setting unit 4 for setting a plurality of pre-determined delay times; an adding unit 5 that adds delay signals Sd1*o*, Sd2*o*, Sd3*o* that each have different delay times; a parameter-detection unit 6 that detects a parameter component from the added signal Sda that indicates an attribute; a signal-conversion unit 8 that generates a control signal Sdm that controls a modulation unit MB based on the detected detection signal Sde; a strength-adjustment unit 7 that sets the strength of the signal conversion performed by the signal-conversion unit 8; and a modulation unit MB that modulates the input signal based on the control signal Sdm that was generated by the signal-conversion unit 8.

The output signal So that is output from the modulation unit MB is amplified by a power amplifier and by amplification equipment such as speakers, headphones or the like, and provided to listeners, or in other words, a disc jockey or people who enjoy dancing, as the input signal Si to which a sound effect has been added.

The input signal Si is a signal that is related to sound information that is output from a media-reproduction apparatus such as a CD, DVD or the like, or a receiving apparatus that receives a television broadcast.

The input signal Si and a delay-time signal Sd1 that indicates the delay time set for the delay unit 1 by the delay-time-setting unit 4 is input to the delay unit 1. The input signal Si is delayed by the delay unit 1 by just the delay time d1 that is represented by the delay-time signal Sd1. As a result, a delay signal Sid1, which is the input signal Si that is delayed by just the delay time d1, is output from the delay unit 1. The output delay signal Sid1 is input to the adding unit 5.

The input signal Si and a delay-time signal Sd2 that indicates the delay time set for the delay unit 2 by the delay-time-setting unit 4 is input to the delay unit 2. The input signal Si is delayed by the delay unit 2 by just the delay time d2 that is represented by the delay-time signal Sd2. As a result, a delay signal Sid2, which is the input signal Si that is delayed by just the delay time d2, is output from the delay unit 2. The output delay signal Sid2 is input to the adding unit 5.

The input signal Si and a delay-time signal Sd3 that indicates the delay time set for the delay unit 3 by the delay-time-setting unit 4 is input to the delay unit 3. The input signal Si is delayed by the delay unit 3 by just the delay time d3 that is represented by the delay-time signal Sd3. As a result, a delay signal Sid3, which is the input signal Si that is delayed by just the delay time d3, is output from the delay unit 3. The output delay signal Sid3 is input to the adding unit 5.

The delay-time-setting unit 4 sets the delay times for delay by each of the delay units 1, 2, 3 based on control from the user such as a disc jockey. It is possible for the user to input delay times d1, d2, d3 as numerical values to the delay-time-setting unit 4.

It is also possible to set the delay time by a method other than inputting numerical values. For example, the user can set the delay time by operating the delay-time-setting unit 4 while listening to sound generated from the input signal Si in order to fit the delay time to that sound.

For example, when the user operates the delay-time-setting unit 4 using the starting portion of the rhythm while listening to the sound, measurement of the delay-time-setting time is started inside the delay-time-setting unit 4. When the disc jockey operates the delay-time-setting unit 4 again to fit the delay to the rhythm, the time that has elapsed since the first time the user operated the delay-time-setting unit 4 becomes delay time d1. Moreover, when the user next operates the delay-time-setting unit 4 to fit the delay to the rhythm, the time that has elapsed since the first time the user operated the delay-time-setting unit 4 becomes the delay time d2. Furthermore, when the user next operates the delay-time-setting unit 4 to fit the delay to the rhythm, the time that has elapsed since the first time the user operated the delay-time-setting unit 4 becomes the delay time d3. It is possible to set the number of times that the delay-time-setting unit 4 has been operated since the first time that the user operated the delay-time-setting unit 4 as the delay time, or it is possible to input a setting to the delay-time-setting unit 4 as a numerical value. It is also possible to clear the values for the delay times d1, d2 and d3, and set new delay times by operating the delay-time-setting unit 4.

Delay signal Sid1, delay signal Sid2 and delay signal Sid3 that were output from delay unit 1, delay unit 2 and delay unit 3 are input to the adding unit 5. The adding unit 5 adds the input delay signals and outputs the added signal Sda.

FIG. 2 graphically shows the signal waveform of the added signal Sda. In FIG. 2, the time is shown along the horizontal axis, and the size of the sound, or in other words, the size of the width of the signal is shown along the vertical axis. The input signal Si is input to the delay units 1, 2, 3 at the timing of the origin O and time T1 on the time axis.

The delay signal Sd1 is generated after the delay time d1, which is set by the delay-time-setting unit 4, has elapsed from the Origin O and timing T1 on the time axis, which is the timing when the input signal Si is input to the delay unit 1, and it indicates an increase in size of the signal. The waveform of the delay signal Sd1 is the same as that of the input signal Si. Moreover, the delay signal Sd2 is generated after the delay time d2, which is set by the delay-time-setting unit 4, has elapsed from the Origin O and timing T1 on the time axis, which is the timing when the input signal Si is input to the delay unit 2, and it indicates an increase in amplitude of the signal. The waveform of the delay signal Sd2 is the same as that of the input signal Si. Furthermore, the delay signal Sd3 is generated after the delay time d3, which is set by the delay-time-setting unit 4, has elapsed from the Origin O and timing T1 on the time axis, which is the timing when the input signal Si is input to the delay unit 3, and it indicates an increase in the size of the signal. The waveform of the delay signal Sd3 is the same as that of the input signal Si.

As shown in FIG. 2, the added signal Sda that is output from the adding unit 5 comprises repeated delay signals Sd1, Sd2 and Sd3 that are delayed by just the delay times d1, d2, d3 that are set by the delay-time-setting unit 4.

The added signal Sda is input to the parameter-detection unit 6. The parameter-detection unit detects a parameter component of added signal Sda and outputs that parameter component as a parameter signal Sde.

More specifically, a filter such as a LPF (Low Pass Filter) is located inside the parameter-detection unit 6, and outputs a signal, which has as its main component the low-frequency component of the input signal Si and expresses the beat such as that of a bass drum, as a change signal Sde. Also, this change signal Sde, which has the low-frequency component as its main component, comprises many components of the input signal Si that express mainly the beat. In the case of listeners that dance in an entertainment facility such as a disco or dance hall, the listeners often dance steps to the beat of sound that includes much of the low-frequency component such as the sound of a bass drum. Therefore, by generating a sound effect (described later) based on the beat detected by the parameter-detection unit 6, it is possible for the listener to enjoy the sound effect while dancing without feeling uncomfortable.

The parameter signal Sde that is output from the parameter-detection unit 6 is input to the signal-conversion unit 8. Based on the parameter signal Sde, and a strength-adjustment signal Ss that is output from a strength-adjustment unit 7 and that indicates the modulation strength, the signal-conversion unit 8 generates a control signal Sdm for controlling the modulation unit MB.

More specifically, the signal-conversion unit 8 generates a control signal Sdm that corresponds with the modulation method of the modulation unit MB after the absolute value |Sde| of the amplitude level of the input parameter signal Sde is detected. FIG. 3, shows the |Sde| signal, which is the absolute value |Sde| of the amplitude level of the input parameter signal Sde. This signal is a signal that expresses the envelope curve on the upper side of the time axis in FIG. 2 of the envelope curves of the added signal Sda signal in FIG. 2. The signal-conversion unit 8 generates the |Sde| signal.

Also, the signal-conversion unit 8 changes the size of the amplitude of the |Sde| signal based on the strength-adjustment signal 7 that is output from the strength-adjustment unit 7.

More specifically, the signal-conversion unit 8 increases the size of the amplitude of the |Sde| signal when the value input to the strength-adjustment unit 7 is large, and decreases the size of the amplitude of the |Sde| signal when the value input to the strength-adjustment unit 7 is small. When the size of the amplitude of the |Sde| signal is large, the change of the control signal Sdm becomes large, and the amount of modulation by the modulation unit 8 becomes large. Also, when the size of the amplitude of the |Sde| signal is small, the change of the control signal Sdm becomes small, and the amount of modulation by the modulation unit 8 becomes small.

Besides being input as a numerical value, the value that is input to the strength-adjustment unit 7 can be input by a variable resistor such as a volume control that changes continuously.

For example, in the case where the strength-adjustment unit 7 is formed from a cylindrical-shaped audio knob, when the knob is turned to the right (clockwise direction), the value input to the strength-adjustment unit 7 increases and changes the strength-adjustment signal Ss that is output from the strength-adjustment unit 7 so that it becomes larger. As a result, the signal-conversion unit 8 controls the size of the amplitude of the |Sde| signal so that it gradually increases to correspond with the rotation position of the cylindrical-shaped audio knob. When the cylindrical-shaped audio knob is turned to the left (counterclockwise direction), the value input to the strength-adjustment unit 7 decreases and changes the strength-adjustment signal Ss that is output from the strength-adjustment unit 7 so that it becomes smaller. As a result, the signal-conversion unit 8 controls the size of the amplitude of the |Sde| signal so that it gradually decreases to correspond with the rotation position of the cylindrical-shaped audio knob.

The control signal Sdm that is output from the signal-conversion unit 8 and the input signal Si is input to the modulation unit MB. The modulation unit MB modulates the input signal SI based on the control signal according to a preset modulation method. The modulated signal is output from the modulation unit MB as an output signal So.

The output signal So is modulated by the modulation unit MB according to the timing at which the delay signals Sid1, Sid2, Sid3 that are added by the adding unit 5 and synchronized with the input signal Si are input to the signal-conversion unit 8. In other words, the input signal Si is modulated to fit the rhythm of the input signal Si, and the output signal So, which is the sound effect that is the result of the function of the sound-processing apparatus S as an effecter, is output from the sound-processing apparatus S. The output signal So that is output from the sound-processing apparatus S is input to a power amplifier (not shown in the figure) that is connected to speakers, and provided to the listeners as a sound effect.

In this way, the sound-processing apparatus S performs synchronization according to the beat of the sound to be modulated, modulates the sound to be modulated and generates a sound effect even when the interval of the beat of the input signal Si that is to be modulated is not fixed, or when the interval of the beat of the input signal Si that is to be modulated gradually becomes longer or shorter.

More specifically, with the construction described above, by fixing the timing at which the sound effect is added to sound such as music that is reproduced by an information-reproduction apparatus such as a CD player or DVD player, the sound effect is generated within a fixed amount of time after the beat is generated, even when there is variation in the beat and rhythm of the sound such as music that is reproduced by an information-reproduction apparatus such as a CD player, so the listener is able to enjoy the sound effect for a sound such as music without feeling uncomfortable.

Also, for the disc jockey as well, the sound effect is generated continuously without the listener having an unpleasant feeling, so it is not necessary to perform troublesome work such as fine adjustment of the timing for generating the sound effect. Also, it is possible for the disc jockey to concentrate on selecting the next information-recording medium such as a CD or the like to be played, or selecting the next sound effect to be generated, so it is possible to provide a sound-processing apparatus S that has very good operability for the disc jockey.

(II) First Embodiment of the Invention

Next, a first embodiment of the invention will be explained using FIG. 4 to FIG. 6. This first embodiment is an embodiment in which the present invention is applied to an apparatus that combines a so-called tap-delay circuit that functions as a delay unit DB that can set a plurality of delay times, and a so-called flanger that obtains a unique swelling sound effect by adding a slightly delayed sound to the input sound and changing that delay time.

Figure 4:
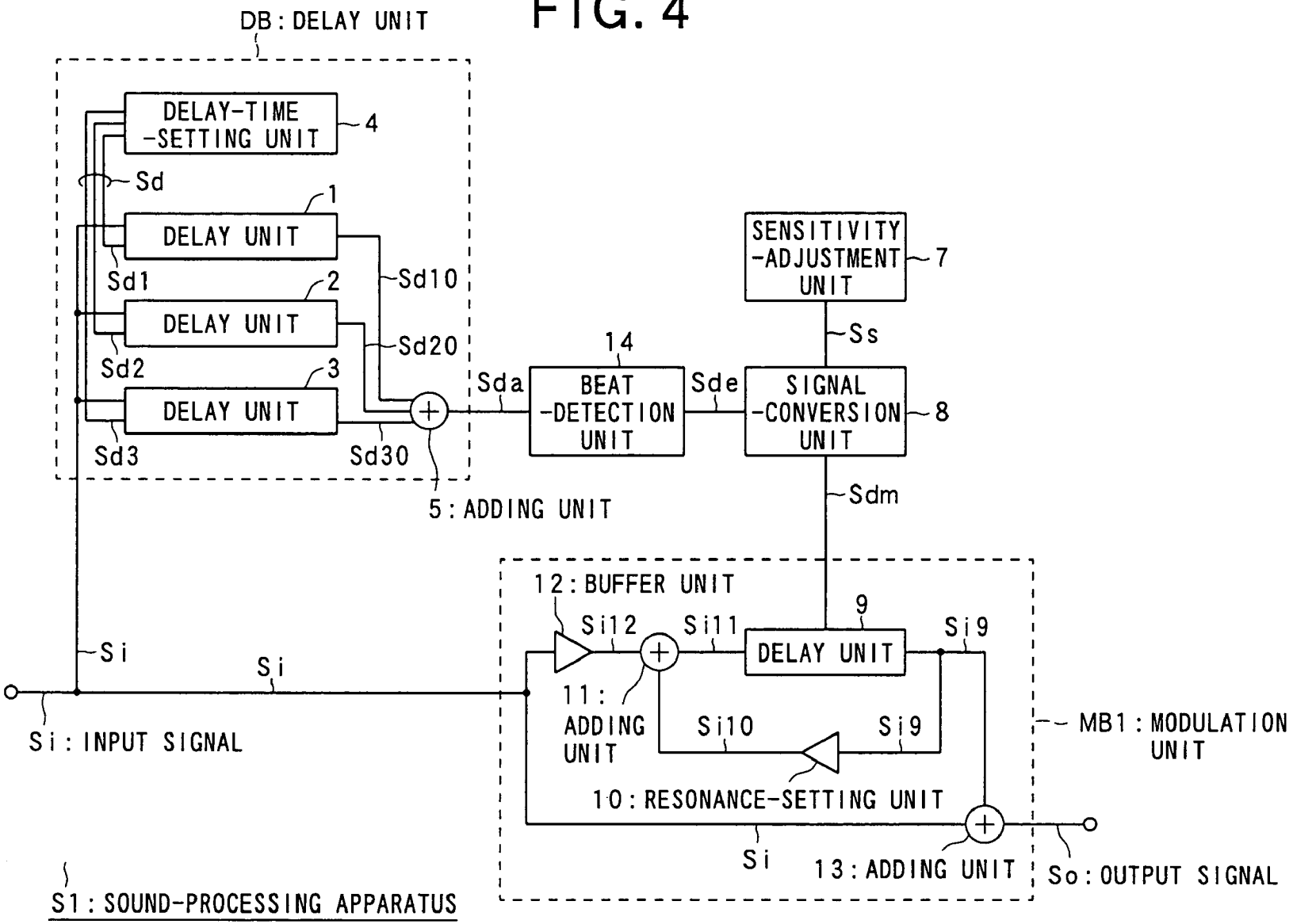
FIG. 4 is a block diagram that shows the construction of a first embodiment of the invention.
Figure 5:
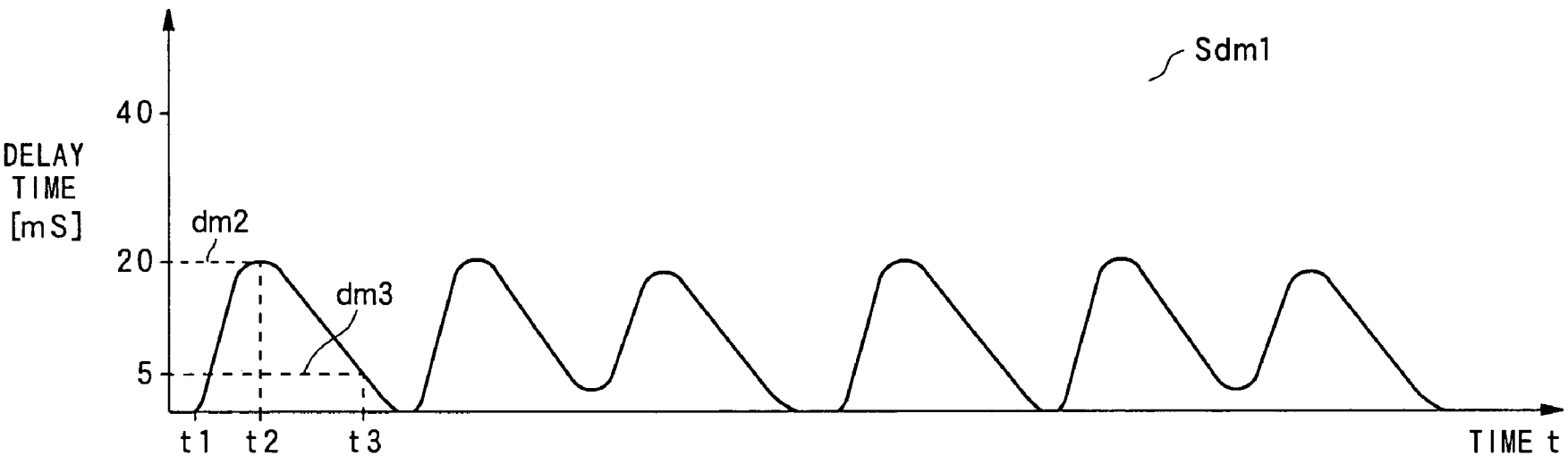
FIG. 5 is a drawing that shows the state of signal conversion of a first embodiment of the invention.
Figure 6:
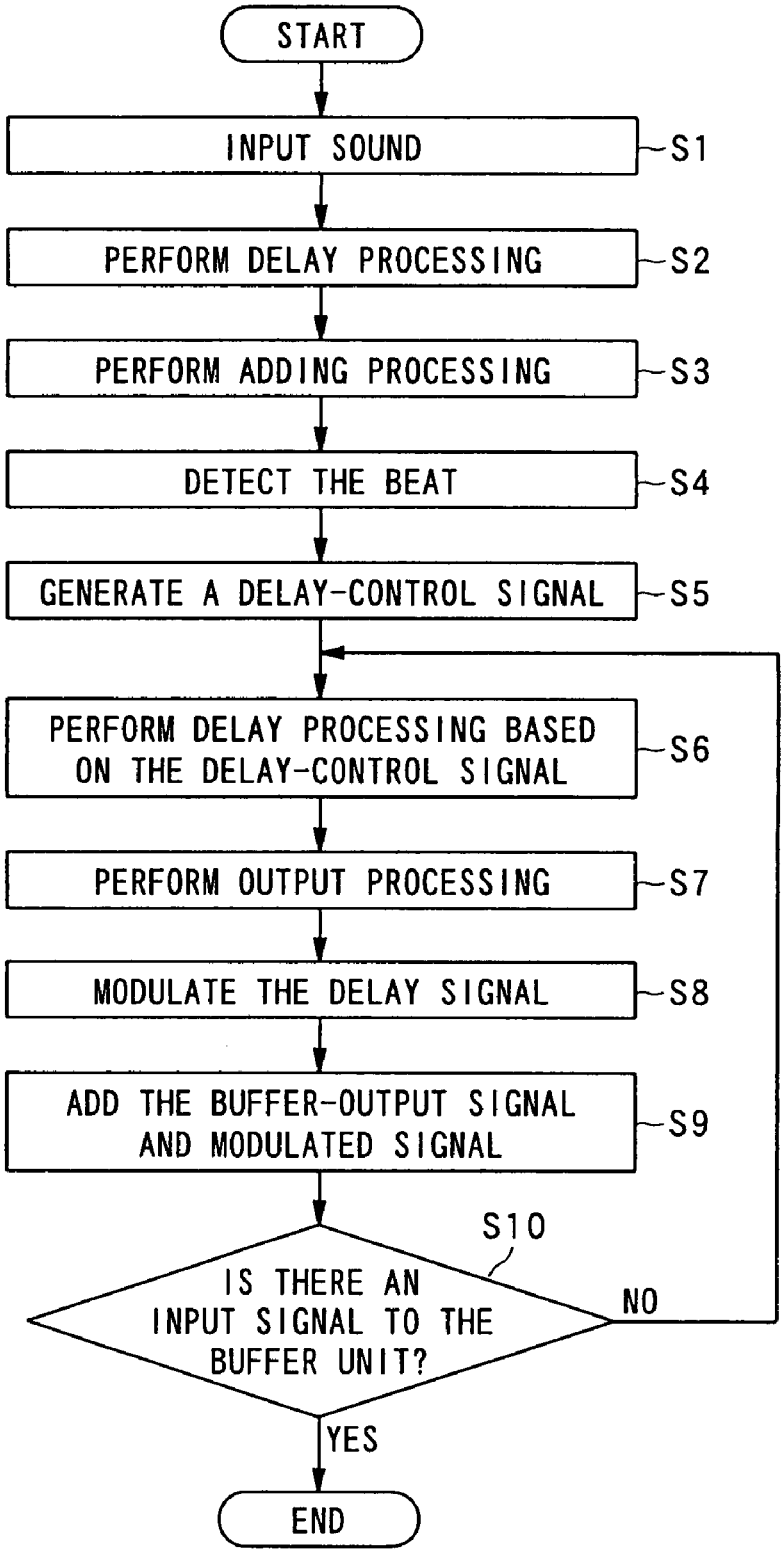
FIG. 6 is a flowchart showing the operation of a first embodiment of the invention.

FIG. 4 is a block diagram of the first embodiment, FIG. 5 is a drawing showing the modulation method of the first embodiment, and FIG. 6 is a flowchart that shows the operation of the first embodiment.

In the first embodiment shown in FIG. 4, the same reference numbers are given to parts that have the same construction and operation of those shown in FIG. 1, and any redundant explanation is omitted.

Next, the unique modulation unit MB1 of this embodiment will be explained. The modulation unit MB1 comprises a delay unit 9, resonance-setting unit 10, adding unit 11, buffer unit 12 and adding unit 13.

The control signal Sdm from the signal-conversion unit 8 is input to the delay unit 9 as a control signal, and the delay unit 9 delays the input signal Si11 according to the signal level of the control signal Sdm and outputs the result as signal Si9.

FIG. 5 shows the relationship between the control signal Sdm and the delay time of the signal Si11. The time axis is shown along the horizontal axis, and the time at which the input signal Si11 that is input to the delay unit 9 is delayed by the delay unit 9 is shown along the vertical axis. The waveform Sdm that is shown in FIG. 5 is similar to the waveform of the control signal.

The method by which the delay unit 9 delays the signal Si11 will be explained in more detail. At time t1 the delay time is 0 ms, so the signal Si11 is not delayed by the delay unit and is output from the delay unit 9 as the output signal Si9. Moreover, it can be seen from the delay time along the vertical axis that at time t2 the delay time dm2 is set to 20 ms. This indicates that at t2, the signal Si11 is output from the delay unit 9 after a delay of 20 ms as signal Si9. Furthermore, at time t3 the delay time dm3 is set to 5 ms. This indicates that at t3, the signal Si11 is output from the delay unit 9 after a delay of 5 ms as signal Si9.

As shown in FIG. 5, the signal Si11 that is input to the delay unit 9 is continuously delayed in proportion to the amplitude level of the control signal Sdm, and is output as signal Si9 after the delay time elapses.

The signal Si9 that is output from the delay unit 9 is input to the resonance-setting unit 10, and the resonance-setting unit 10 adjusts the gain of the signal Si9 based on a gain-control value that was set by the user, and outputs the gain-adjusted signal as Si10.

For example, in the case where the resonance-setting unit 10 is constructed from a cylindrical-shaped audio knob, when the user turns the knob to the right (clockwise direction), the signal Si10 that is output has an amplitude that is greater than before the knob was turned. Also, when the knob is turned to the left (counterclockwise direction), the signal Si10 that is output has an amplitude that is less than before the knob was turned.

The adding unit 11 adds the signal Si12, which is output from the buffer unit 12 and that is equal to the input signal Si, and the signal Si10, whose gain was adjusted by the resonance-setting unit 10 after the input signal Si was time delayed by the delay unit 9, and outputs the signal Si12 as an output signal.

The buffer unit 12 is constructed so that it has a large input resistance and small output resistance. The input signal Si is input to the buffer unit 12, and the buffer unit 12 outputs the signal Si12. The buffer unit 12 changes the impedance so that the input signal Si having a large input impedance is output as signal Si12 having a smaller output impedance. As a result, in the adding unit 11, which is the step following the buffer unit 12, it becomes possible to efficiently add the input signal Si. There is no change to the waveform before and after the buffer unit 12.

The adding unit 13 adds the signal Si9 that is output from the delay unit 9 and the input signal Si, and outputs the result as output signal So.

By adding the input signal Si and the signal Si9, which is the input signal Si that has been delayed by the delay unit 9, small peaks and valleys in which interference occurs are in generated in the frequency of this output, and changes to the signal occur slowly. As a result, when the output signal So is listened to by way of an amplifier such as a speaker, an effect like that of the swelling noise of jet aircraft passing over is obtained.

Also, since the signal Si9 is added to the input signal Si, the sound effect that is synchronized with the beat of the input signal Si is amplified after the delay time that was set by the delay-time-setting unit 4 has elapsed.

FIG. 6 is a flowchart showing the operation of this first embodiment.

In step S1, the input signal Si is input to the sound-processing apparatus S1 of this first embodiment.

In step S2, the input signal Si is delayed based on the delay times that were set by the delay-time-setting unit 4. The delay signal Sd10 that was delayed by just the delay time d1 is output from the delay unit 1, the delay signal Sd20 that was delayed by just the delay time d2 is output from the delay unit 2, and the delay signal Sd30 that was delayed by just the delay time d3 is output from the delay unit 3.

In step S3, the delay signal Sd10, delay signal Sd20 and delay signal Sd30 that were generated in step S2 are added by the adding unit 5. The added signal is then output as added signal Sda.

In step S4, the beat-detection unit 14 detects the parameter signal Sde that includes much of the relatively low frequency component of the signal components included in the added signal Sda.

In step S5, the signal-conversion unit 8 detects the absolute value |Sde| of the parameter signal Sde from the parameter signal Sde, and outputs that detected signal as a control signal Sdm.

In step S6, the delay unit 9 delays the signal Si11 that is input to the delay unit 9 according to amplitude level of the control signal Sdm, and outputs the result from the delay unit 9 as signal Si9.

In step S7, the adding unit 13 adds the signal Si9, which is the delayed signal that was output from the delay unit 9, and the input signal Si that was input to the sound-processing apparatus S1, and outputs the result from the sound-processing apparatus as output signal So. When the output signal So is provided to an audience by way of an amplifier such as speakers (not shown in the figures), a sound effect such as the swelling sound from a jet airplane passing over is heard.

In step S8, the resonance-setting unit 10 adjusts the gain of the signal Si9 that was output from the delay unit 9. The adjusted signal is output from the resonance-setting unit 10 as signal Si10.

In step S9, the adding unit 11 adds the signal Si12 that was output from the buffer unit 12 and the signal Si10 that was output from the resonance-setting unit 10, and outputs the result to the delay unit 9 as signal Si11.

In step S10, a check is performed to determine whether or not there is an input signal Si to input to the buffer unit 10. When there is no input signal Si, processing ends. When there is an input signal Si, processing returns to step S6.

With the sound-processing apparatus S1 of this embodiment, a time delay is generated for the sound to be modulated based on the level of the sound that was detected by the signal-conversion unit 8, which is an example of sound-level-detection means. Also, the adding unit 13 adds the time-delayed sound to be modulated to the sound to be modulated that has not been delayed. The time delay is generated based on the sound level, so the sound to be modulated and the time-delayed sound to be modulated are added at every fixed interval in synchronization with the beat of the sound to be modulated. The amount of time delay at this time changes based on the sound level, so the added output sound is output as a sound effect having a unique swelling effect.

Therefore, with this sound-processing apparatus S1, it is possible to generate the sound effect described above having unique swelling in synchronization with the beat of the sound to be modulated. As a result, it is possible to enjoy sound effects having various time differences with respect to one beat.

Also, it is possible for the disc jockey to extemporaneously generate a sound effect according to his/her sense by way of the delay-time-setting unit 4 as an example of time-difference-setting means. Moreover, this sound-processing apparatus S1 is capable of generating a variety of sound effects that fit the atmosphere of the location and the sound that is output from an information-reproduction apparatus such as a CD player, and that correspond to the beat of the sound to be modulated, so it is possible for listeners to enjoy stimulating sound effects that correspond to the beat of the sound to be modulated. Furthermore, since the disc jockey does not need to worry about the sound effect becoming out of phase from the beat, it is possible for the disc jockey to have more time to prepare for generating for the next sound effect or for selecting the next sound to be reproduced.

More specifically, conventionally, modulation was set based on the sound level of a simple triangular waveform or triangular type sine waveform, so it was only possible for the listener to enjoy a sound effect according to the amount of modulation based on a set pattern. However, with the construction of this embodiment, the waveform of the sound to be modulated freely changes, so amount of modulation is performed according to an unpredicted pattern, and it becomes possible for the user to enjoy sound effects having various patterns.

For example, it is possible for the disc jockey to use the sound-processing apparatus to generate various sound effects in a location such as a dance hall, so it is possible for the user to enjoy different kinds of dancing.

In the explanation of this embodiment, the number of delay times delayed by the delay-time-setting unit 4 and the number of delay units used was three, however, the embodiment is not limited to three, and it is possible for the embodiment to be constructed such that it is not limited to three and can use any arbitrary number of delay times delayed by the delay-time-setting unit 4 and number of delay units.

(III) Second Embodiment

Figure 7:
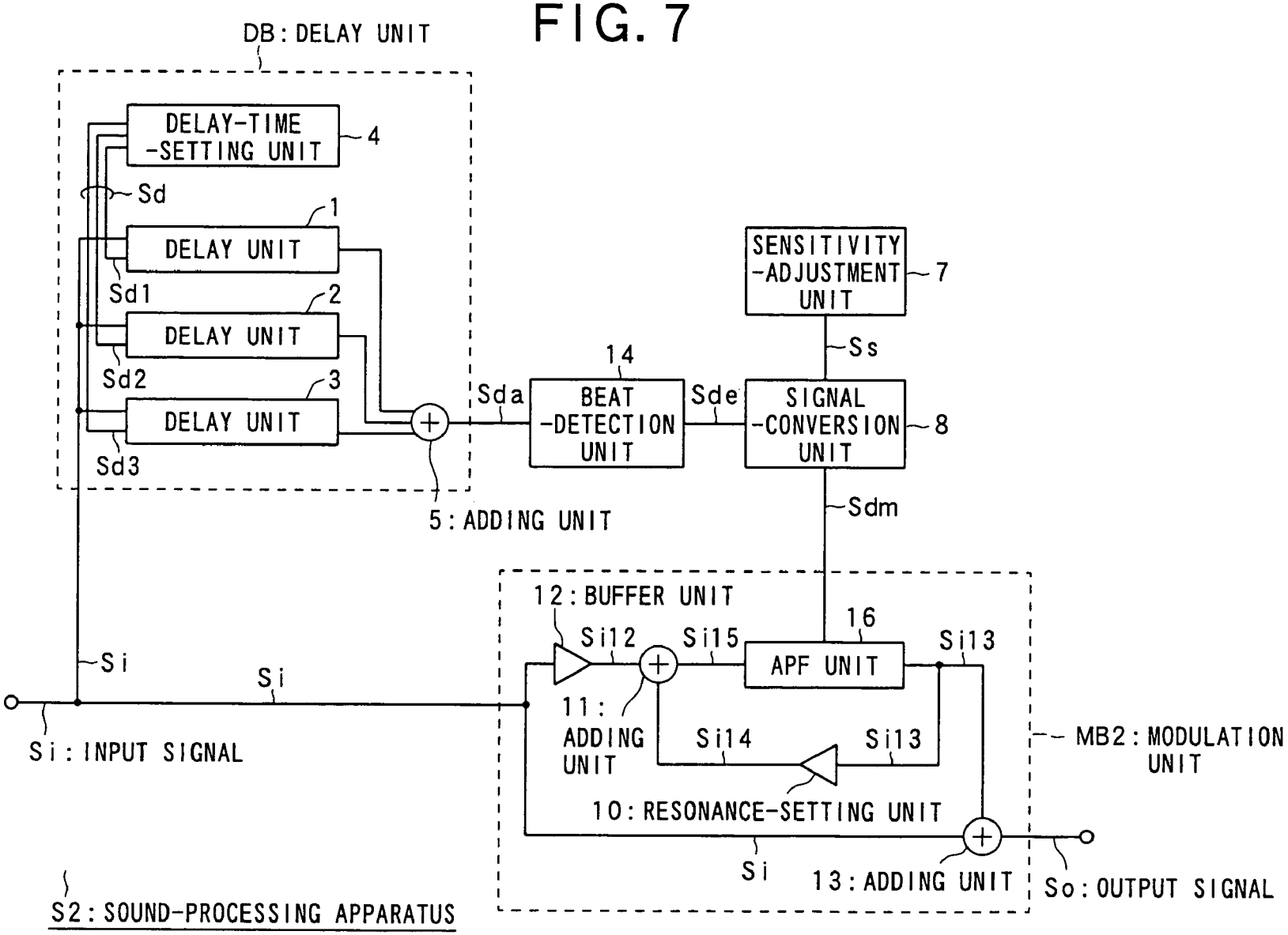
FIG. 7 is a block diagram that shows the construction of a second embodiment of the invention.
Figure 8:
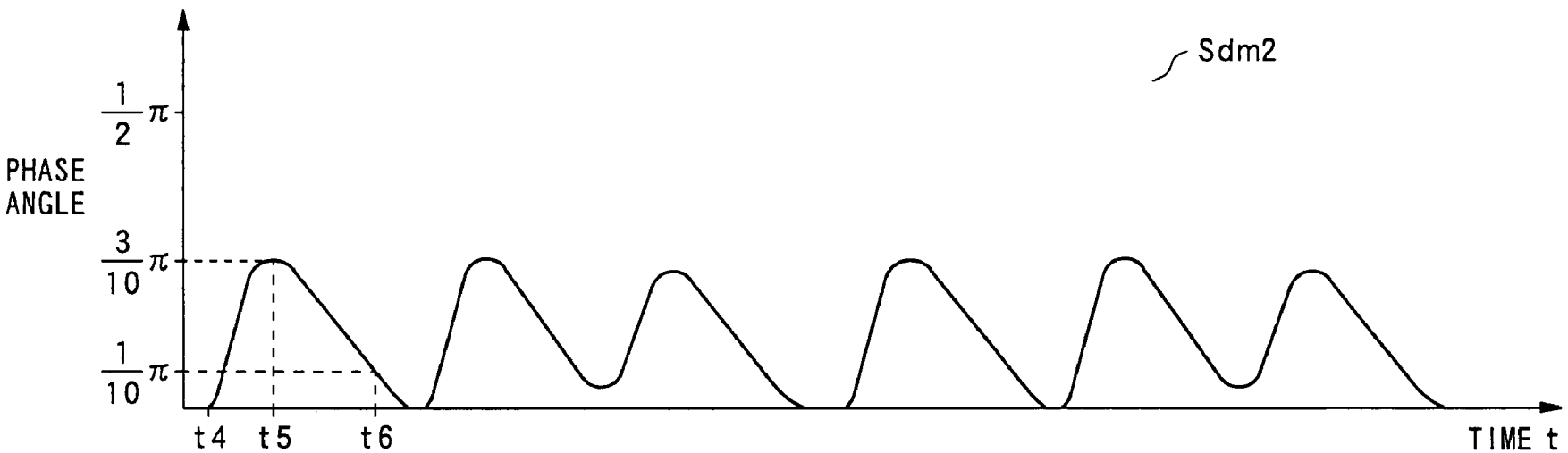
FIG. 8 is a drawing that shows the state of signal conversion of a second embodiment of the invention.
Figure 9:
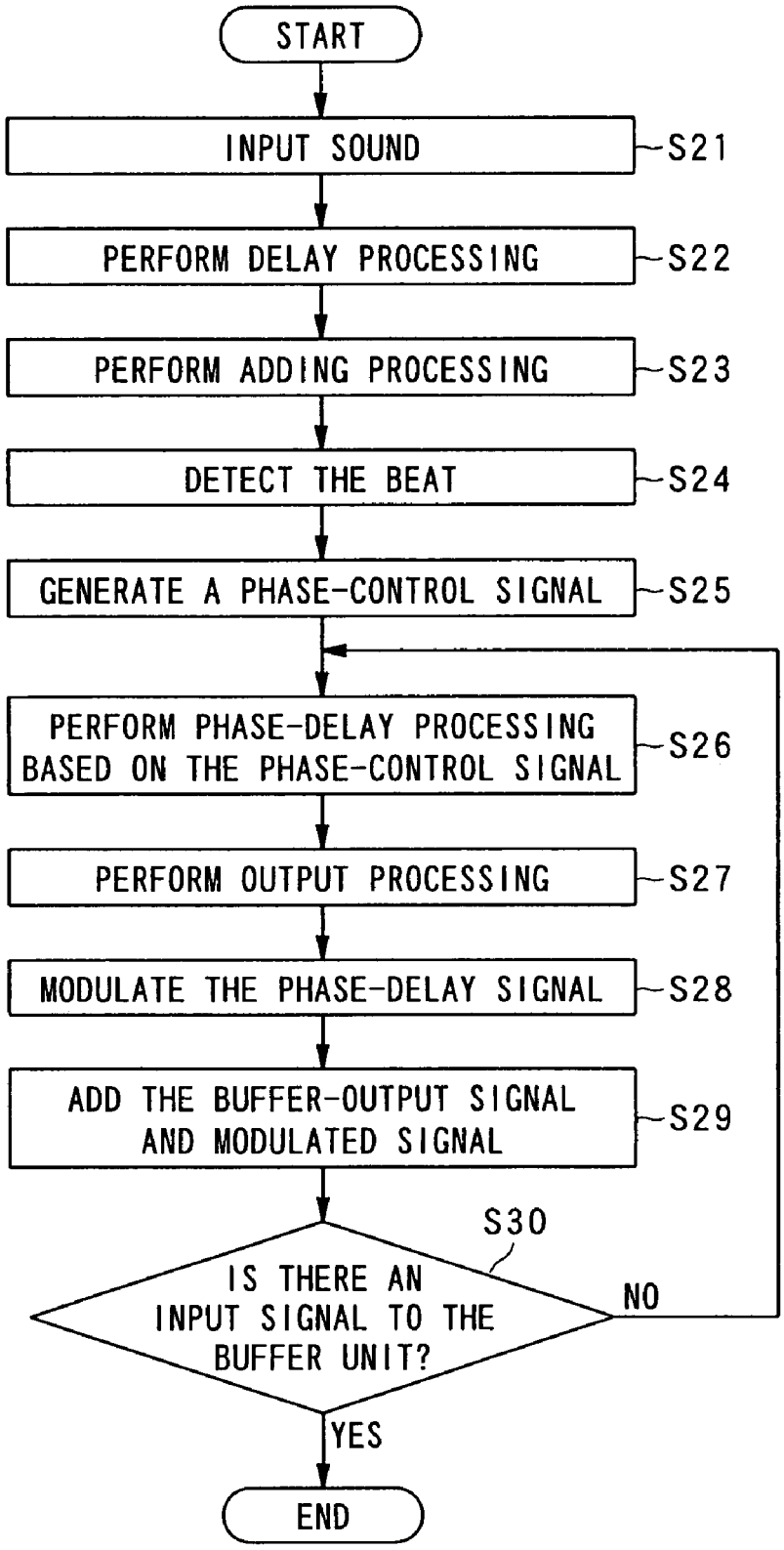
FIG. 9 is a flowchart showing the operation of a second embodiment of the invention.

Next, FIG. 7 to FIG. 9 will be used to explain a second embodiment of the invention. This second embodiment is an embodiment in which the present invention is applied to an apparatus that combines a so-called tap-delay circuit that functions as a delay unit DB that is capable of setting a plurality of delay times, and a so-called phaser that adds the input sound whose phase has been changed, and obtains a unique swelling sound effect by changing that phase.

FIG. 7 is a block diagram of this second embodiment, FIG. 8 is a drawing showing the modulation method of this second embodiment, and FIG. 9 is a flowchart showing the operation of this second embodiment.

In the second embodiment shown in FIG. 7, the same reference numbers are used for parts whose overall construction and operation are the same as those shown in FIG. 1, and any redundant explanation will be omitted.

Next, the unique modulation unit MB2 of this second embodiment comprises: a resonance-setting unit 10, an adding unit 11, a buffer unit 12, an adding unit 13 and an APF (All Pass Filter) unit 16. The APF unit 16 is a filter circuit that is used for letting signals within all frequency ranges pass, and for changing just the phase. A control signal from the signal-conversion unit 8 is input to the APF unit 16 as a control signal, and the APF 16 changes the amount of phase delay of the signal Si15, which is a signal that is input in accordance to the signal level of the control signal Sdm, and outputs the result as signal Si13.

FIG. 8 shows the relationship between the control signal Sdm and the amount of phase delay of the signal Si13. The horizontal axis is the time axis, and the vertical axis is the phase angle (where $2\pi$ represents 360 degrees) and is the phase angle of the signal Si15 that is input to the APF unit 16 and that is delayed by the APF unit 16. The waveform Sdm2 that is shown in FIG. 5 is similar to that of the control signal Sdm.

Next, the method that the APF unit 16 uses to delay the phase of the signal Si15 will be explained in detail. The phase at time t4 is 0, so the phase of the signal Si15 is not delayed by the APF unit 16, and that input signal Si15 is output as is from the APF unit 16 as the signal Si13. Also, it can be seen that at time t5 the amount of phase delay pm2 is set to $3\cdot\pi/10$ from the phase angle on the vertical axis. This indicates that at time t5, the APF unit 16 delays the phase of the signal Si15 by $3\cdot\pi/10$, after which the result is output as signal Si13. Furthermore, at time t6, the amount of phase delay pm3 is set to $1\cdot\pi/10$. This indicates that at time t6, the APF unit 16 delays the phase of the signal Si15 by $1\cdot\pi/10$, after which the result is output as signal Si13.

As is shown in FIG. 8, the phase of the signal Si15 that is input to the APF unit 16 is continuously delayed in proportion to the amplitude level of the control signal Sdm, and after the phase has been delayed, the result is output as signal Si13.

The signal Si13 that is output from the APF unit 16 is input to the resonance-setting unit 10, and the resonance-setting unit 10 adjusts the gain based on a gain-control value that was set by the user, and outputs the gain-adjusted signal as signal Si14.

For example, in the case where the resonance-setting unit 10 is constructed from a cylindrical-shaped audio knob, when the user turns the knob to the right (clockwise direction), a signal Si14 whose amplitude is greater than that of the signal before the knob was turned is output. Also, when the user turns the knob to the left (counterclockwise direction), a signal Si14 whose amplitude is less than that of the signal before the knob was turned is output.

The adding unit 11 adds the signal Si12, which is equivalent to the input signal Si and is the output signal from the buffer unit 12, and the signal Si14, which is the result signal whose gain was adjusted by the resonance-setting unit 10 after the phase of the input signal Si was delayed by the APF unit 16, and outputs the signal Si15 as the output signal.

The adding unit 13 adds the signal Si9 that is output from the delay unit 9 and the input signal Si, and outputs the result as output signal So.

By adding the input signal Si and the signal Si13, which is the result of delaying the phase of the input signal Si by the APF unit 16, interference occurs, minute peaks and valleys occur in the frequency, and the signal changes slowly. As a result, when the output signal So is provided to an audience by way of an amplifier such as speakers, a sound effect such as a unique swelling like effect is obtained.

Also, since the signal Si13 is added to the input signal Si, a sound effect that is synchronized with the beat of the input signal is amplified after the delay time that was set by the delay-time-setting unit 4 has elapsed.

FIG. 8 is a flowchart showing the operation of the second embodiment.

In step S21, the input signal Si is input to the sound-processing apparatus S2 of the second embodiment.

In step S22, the input signal Si is delayed based on the delay time that was set by the delay-time-setting unit 4. The delay signal Sd10 that is delayed by just the delay time d1 is output from delay unit 1, the delay signal Sd20 that is delayed by just the delay time d2 is output from delay unit 2, and the delay signal Sd30 that is delayed by just the delay time d3 is output from delay unit 3.

In step S23, adding unit 5 adds delay signal Sd10, delay signal Sd20 and delay signal Sd30 that were generated in step S22. The added signals are output as added signal Sda.

In step S24, from among the signal components contained in the added signal Sda, the beat-detection unit 14 detects a parameter signal Sde that contains much of the relatively low-frequency component.

In step S25, the signal-conversion unit 8 detects the absolute value |Sde| of the parameter signal Sde from the parameter signal Sde, after which the signal-conversion unit 8 further detects the envelope curve of |Sde|. The detected signal is output from the signal-conversion unit 8 as a control signal Sdm.

In step S26, the APF unit 16 delays the phase of the signal Si15 that is input to the APF unit 16 in accordance with the amplitude level of the control signal Sdm, and outputs the result as signal Si13.

In step S27, the adding unit 13 adds the signal Si13 that is the delay signal that is output from the APF unit 16, and the input signal S1 that is input to the sound-processing apparatus S2, and outputs the output signal So from the sound-processing apparatus S2. When the output signal So is provided to an audience by way of an amplifier (not shown in the figure) such as speakers, it is heard as a sound effect having a unique swelling effect.

In step S28, the resonance-setting unit 10 adjusts the gain of the signal Si13 that is output from the APF unit 16. The gain-adjusted signal is then output from the resonance-setting unit 10 as signal Si14.

In step S29, the adding unit 11 adds the signal Si12 that was output from the buffer unit 12, and the signal Si14 that was output from the resonance-setting unit 10, then outputs the result to the APF unit 16 unit as signal Si15.

In step S30, a check is performed to determine whether or not there is an input signal Si to input to the buffer unit 10. When there is no input signal Si, processing ends. When there is an input signal Si, processing returns to step S26.

With the sound-processing apparatus S2 of this embodiment, it is possible to generate sound of which the high-frequency component having one or more unique swell is synchronized with the beat of the sound to be modulated. As a result, it is possible to enjoy a sound effect having various time differences for one beat.

Also, it is possible for the disc jockey to extemporaneously generate a sound effect according to his/her sense by way of the delay-time-setting unit 4. Moreover, this sound-processing apparatus S2 is capable of generating a variety of sound effects that fit the atmosphere of the location and the sound that is output from an information-reproduction apparatus such as a CD player, and that correspond to the beat of the sound to be modulated, so it is possible for listeners to enjoy stimulating sound effects that correspond to the beat of the sound to be modulated.

Furthermore, since the disc jockey does not need to worry about the sound effect becoming out of phase from the beat, it is possible for the disc jockey to have more time to prepare for generating the next sound effect or for selecting the next sound to be reproduced.

(IV) Third Embodiment

Figure 10:
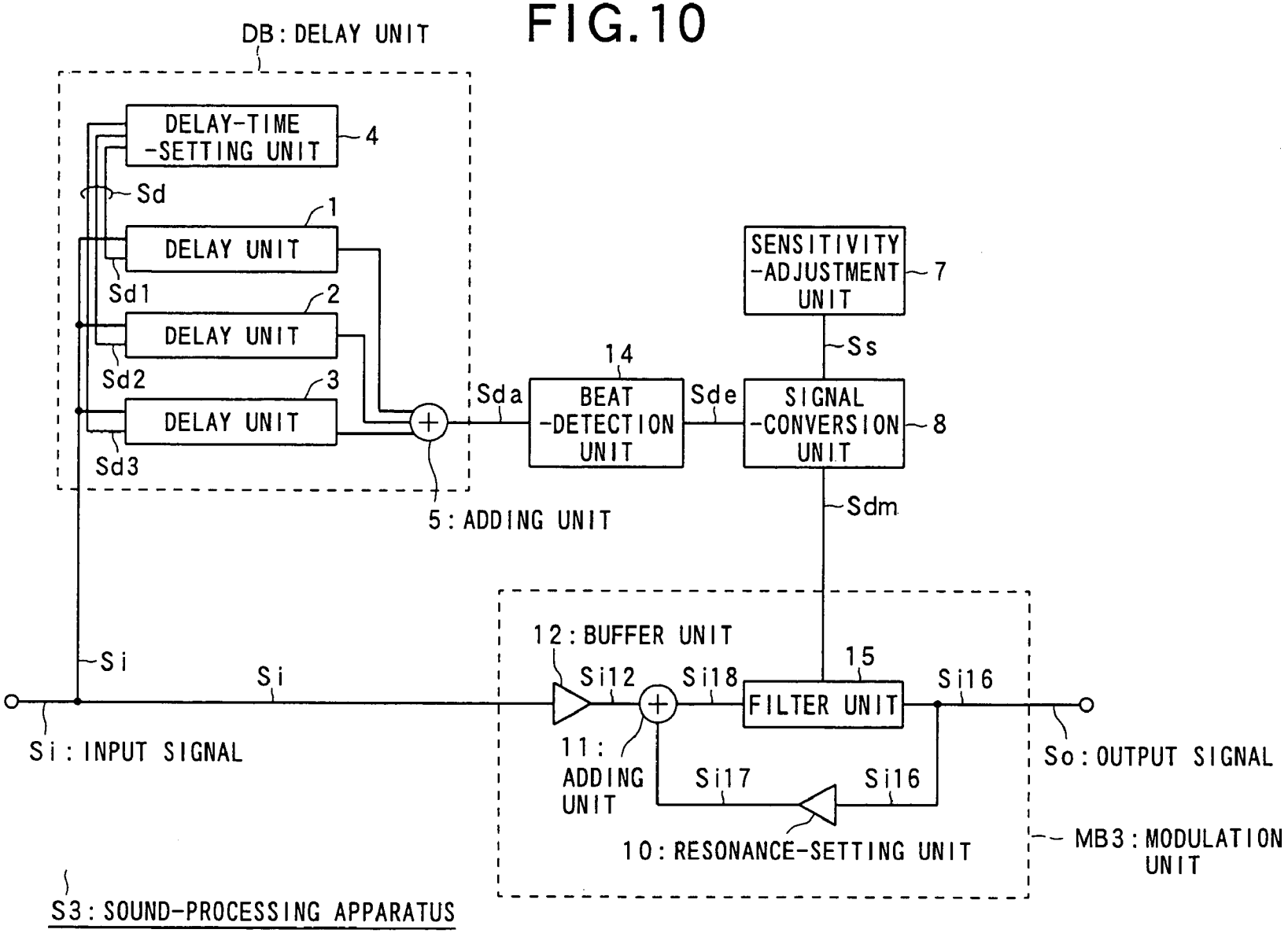
FIG. 10 is a block diagram that shows the construction of a third embodiment of the invention.
Figure 11:
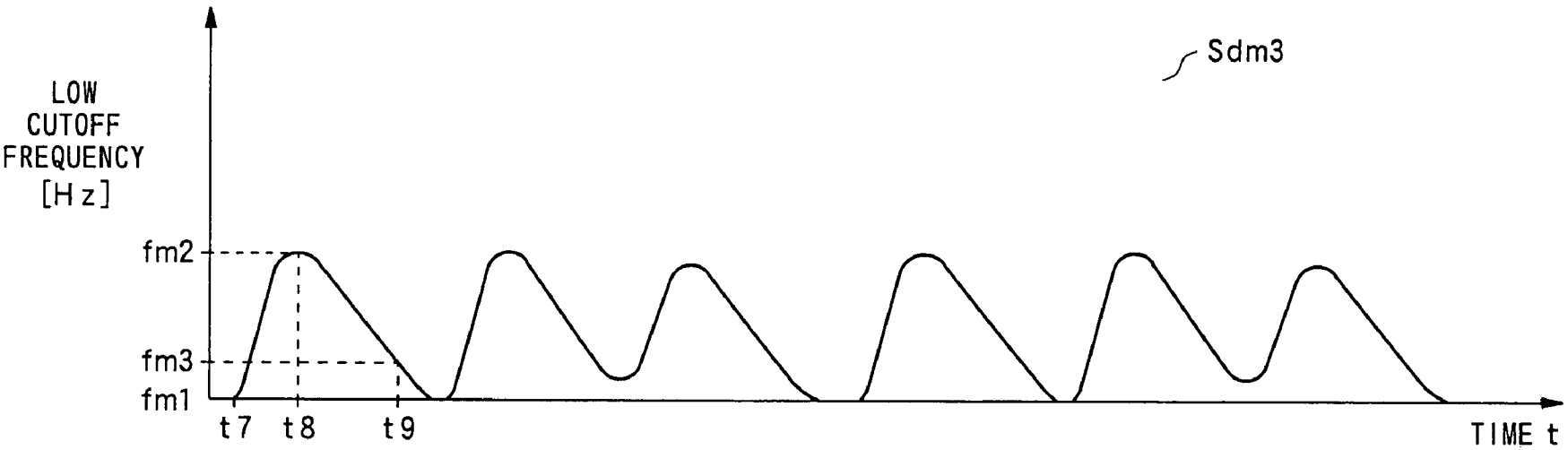
FIG. 11 is a drawing that shows the state of signal conversion of a third embodiment of the invention.

Next, FIG. 10 and FIG. 11 will be used to explain a third embodiment of the invention. This third embodiment is an embodiment in which the present invention is applied to an apparatus that combines a so-called tap-delay circuit that functions as a delay unit DB that is capable of setting a plurality of delay times, and a so-called filter circuit that adds a sound, whose low-pass frequency has been changed, to the input sound, and obtains a unique sound effect that changes the cutoff frequency of that low-pass frequency.

FIG. 10 is a block diagram of a third embodiment, and FIG. 9 is a flowchart showing the operation of this third embodiment.

In the third embodiment shown in FIG. 10, the same reference numbers are used for parts whose overall construction and operation are the same as those shown in FIG. 1, and any redundant explanation will be omitted.

The modulation unit MB2 comprises: a resonance-setting unit 10, adding unit 11, buffer unit 12, adding unit 13 and filter unit 15.

The filter unit 15 is a so-called LPF circuit that lets signals within the low-frequency range pass. The control signal Sdm from the signal-conversion unit 8 in input as a control signal, and the filter unit 15 changes the low cutoff frequency of the signal Si18 according to the signal level of the control signal Sdm, and outputs the low-frequency component that is lower than the low cutoff frequency as signal Si16.

FIG. 11 shows the relationship between the control signal Sdm and the low cutoff frequency of the signal Si18. The horizontal is the time axis, and the vertical axis is the cutoff frequency (Hz), which is a frequency near the upper limit of the low-frequency component at which the signal Si18 that is input to the filter unit 15 passes through the filter unit 15. The waveform Sdm3 shown in FIG. 11 is similar to that of the control signal Sdm.

FIG. 11 will be used to explain in more detail the method used by the filter unit 15 for changing the low cutoff frequency of the signal Si18. At time t7, the cutoff frequency is fm1 Hz, so of the frequency component of the signal Si18, the frequency component that is less than that frequency fm1 is allowed to pass as is through the filter unit 15. However, of the frequency component of the signal Si18, the frequency component greater than the frequency fm1 is greatly damped by the filter unit 15.

Also, at time t8, it can be seen that the low-cutoff frequency is set to fm2. This indicates that at time t8, of the frequency component of the signal Si18, the frequency component that is less than the frequency fm2 is allowed to pass as is through the filter unit 15. However, of the frequency component of the signal Si18, the frequency component that is greater than frequency fm2 is greatly damped by the filter unit 15.

Furthermore, at time t9, it can be seen that the low-cutoff frequency is set to fm3. This indicates that at time t9, of the frequency component of the signal Si18, the frequency component that is less than the frequency fm3 is allowed to pass as is through the filter unit 15. However, of the frequency component of the signal Si18, the frequency component that is greater than frequency fm3 is greatly damped by the filter unit 15.

As can be seen in FIG. 11, the low-cutoff frequency of the signal Si15 that is input to the filter unit 15 is continuously changed in proportion to the amplitude level of the control signal Sdm, and the frequency component that is less than that low-cutoff frequency is output as signal Si13.

Figure 12:
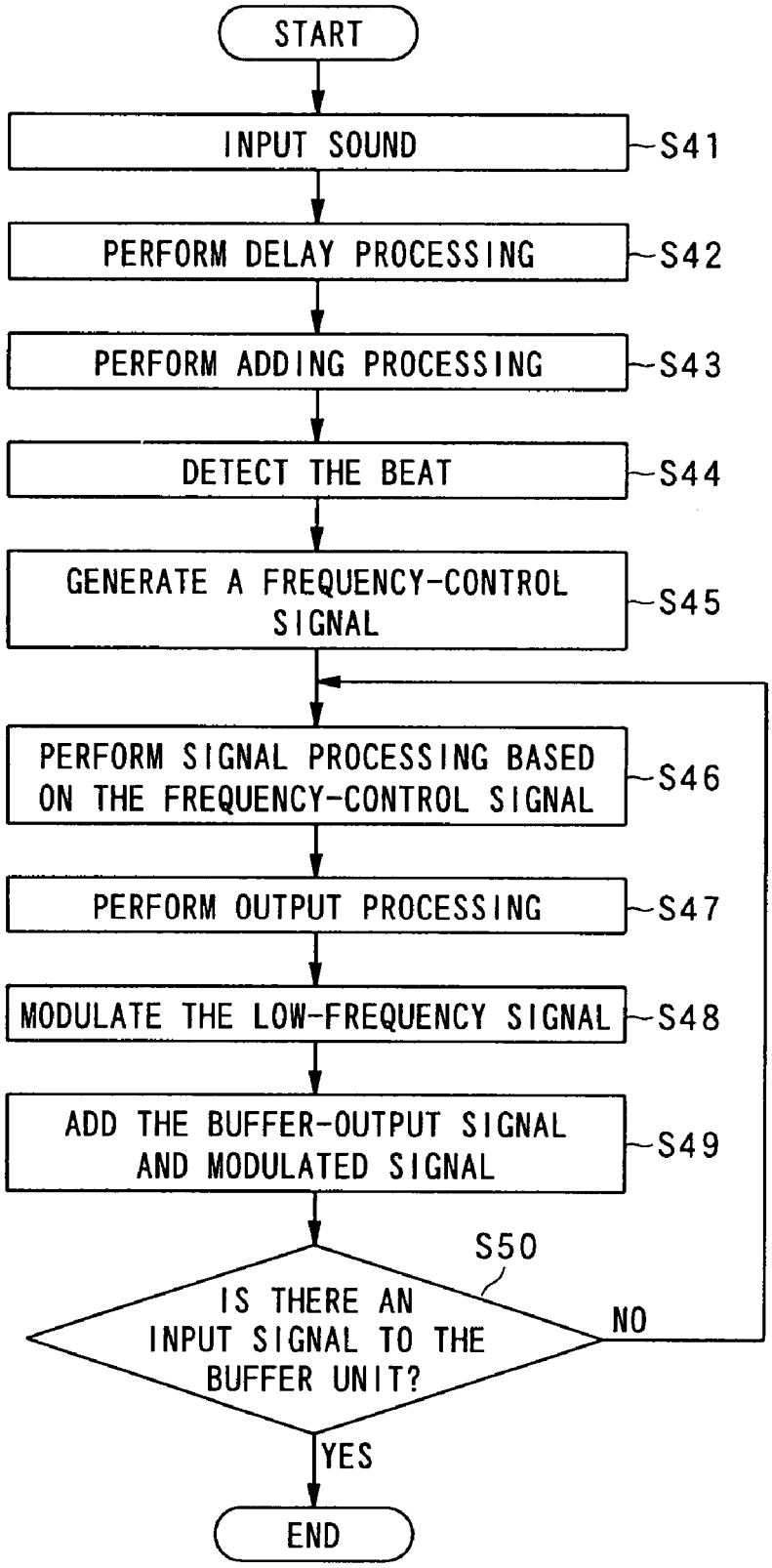
FIG. 12 is a flowchart showing the operation of a third embodiment of the invention.

FIG. 12 is a flowchart showing the operation of this third embodiment.

In step S41, the input signal Si is input to the sound-processing apparatus S3 of this third embodiment.

In step S42, the input signal Si is delayed based on the delay times set by the delay-time-setting unit 4. The delay signal Sd10 that is delayed by just delay time d1 is output from delay unit 1, the delay signal Sd20 that is delayed by just delay time d2 is output from delay unit 2, and the delay signal Sd30 that is delayed by just delay time d3 is output from delay unit 3.

In step S43, the adding unit 5 adds delay signal Sd10, delay signal Sd20 and delay signal Sd30 that were generated in step 42. The added signals are output as added signal Sda.

In step S44, a beat-detection unit 14 detects a parameter signal Sde containing much of the relatively low frequency component of the signal component included in the added signal Sda.

In step S45, a signal-conversion unit 8 detects the absolute value |Sde| of the parameter signal Sde from the parameter signal Sde, after which the signal-conversion unit 8 detects the envelope curve of |Sde|. The detected signal is output from the signal-conversion unit 8 as a control signal Sdm.

In step S46, the filter unit 15 changes the upper frequency at which the low-frequency component of the input signal Si18 that is input to the filter unit 15 is allowed to pass according to the amplitude level of the control signal Sdm, and outputs that low-frequency component from the filter unit 15 as signal Si16.

In step S47, the signal Si16 that was output from the filter unit 15 is output from the sound-processing unit S3 as output signal So. When the output signal So is provided to an audience by way of an amplifier (not shown in the figure) such as speakers, it can be heard as a sound effect having a unique low-frequency swelling effect.

In step S48, the resonance-setting unit 10 adjusts the gain of the signal Si16 that was output from the filter unit 15. The gain-adjusted signal is output from the resonance-setting unit 10 as signal Si17.

In step S49, the adding unit 11 adds the signal Si12 that was output from the buffer unit 12, and the signal Si17 that was output from the resonance-setting unit 10, then outputs the result to the filter unit as signal Si18.

In step S50 a check is performed to determine whether or not there is an input signal Si to input to the buffer unit 10. When there is no input signal Si, processing ends. Where there is an input signal Si, processing returns to step S46.

With this sound-processing apparatus S3, the cutoff frequency of the low-frequency component changes, so it is possible to generate a unique sound that is synchronized with the beat of the sound to be modulated. As a result, it is possible to enjoy a sound effect having various time differences corresponding to one beat.

Also, it is possible for the disc jockey to extemporaneously generate a sound effect according to his/her sense by way of the delay-time-setting unit 4. Moreover, this sound-processing apparatus S3 is capable of generating a variety of sound effects that fit the atmosphere of the location or the sound that is output from an information-reproduction apparatus such as a CD player, and that corresponds to the beat of the sound to be modulated, so it is possible for listeners to enjoy stimulating sound effects that correspond to the beat of the sound to be modulated.

Furthermore, since the disc jockey does not need to worry about the sound effect becoming out of phase from the beat, it is possible for the disc jockey to have more time for preparing for generating the next sound effect or for selecting the next sound to be reproduced.

With the invention described above, sound such as music that is reproduced by a CD player or the like is input as a sound to be modulated to a delay unit 4. The beat of the sound to be modulated is detected by a beat-detection unit 14, and based on the timing of that beat, a signal-conversion unit 8 generates a converted signal. This converted signal is a control signal for controlling a modulation unit MB, and the sound such as music that is reproduced by a CD player or the like and that is input to the modulation unit MB is modulated based on the change of the converted signal. In other words, the timing for modulation is synchronized with the sound to be modulated. The modulated sound is output as a sound effect.

With this construction, when the interval between beats of the sound to be modulated is not fixed, or when the interval between beats of the sound to be modulated gradually becomes longer or shorter, the sound to be modulated is synchronized with the beat of the sound to be modulated and modulated, and a sound effect is generated.

More specifically, by fixing the timing of adding a sound effect to sound such as music that is reproduced by an information-reproduction apparatus such as a CD player with the construction described above, the sound effect is generated within a fixed time after the beat is generated even when there are changes in beat and rhythm of the sound such as music that is reproduced by an information-reproduction apparatus such as a CD player, so it is possible for the listener to enjoy a sound effect to sound such as music without feeling uncomfortable.

Also, for a disc jockey, the sound effect is continuously generated without the listener feeling uncomfortable, so the disc jockey does not have to perform the tedious work of fine tuning the timing for generating the sound effect. Moreover, the disc jockey is able to concentrate more on selecting the next information-recording medium such as a CD to be reproduced, or selecting the next sound effect to be generated, so it possible to provide a sound-processing apparatus that has very good operability for the disc jockey.

Also, with this invention, a sound that is detected by the beat-detection unit 14 that is in synchronization with the sound to be modulated is input to sound-level-detection means. Then, the signal-conversion unit 8 detects the waveform of the sound to be modulated. The modulation unit MB decreases the modulation of the sound to be modulated to correspond to the portion of the waveform detected by the signal-conversion unit 8 having a small level. Moreover, the modulation unit MB increases the modulation of the sound to be modulated to correspond to the portion of the waveform detected by the signal-conversion unit 8 having a large level.

Conventionally, modulation was set based on the sound level of a simple triangular waveform or triangular-type sine waveform, so it was only possible for the listener to enjoy sound effects according to the amount of modulation that was based on a set pattern.

However, with this construction, the waveform of the sound to be modulated freely changes, so modulation is performed according to an unpredicted pattern, and it becomes possible for the user to enjoy sound effects having various patterns.

For example, it is possible for the disc jockey to use the sound-processing apparatus to generate various sound effects in a location such as a dance hall, so it is possible for the users to enjoy different kinds of dancing.

Furthermore, with this invention, it is possible to freely set by way of the delay-time-setting unit 4 time differences between the sound signal to be modulated and a synchronized sound that is generated by the delay unit DB. Also, the invention is not limited to one synchronized sound, and it is possible to generate a plurality of synchronized sounds having differing time differences.

With this construction, it is possible to generate a plurality of synchronized sounds that are synchronized with the beat of the sound to be modulated, and to generate a plurality of sound effects based on the plurality of synchronized sounds by modulation means. As a result, it is possible to enjoy sound effects having various patterns for one beat.

Also, in addition to setting a time difference by inputting a time-difference value, it is possible to automatically set a time difference from the beat of the sound to be modulated by having the disc jockey tap out and input a beat by hand. In this case, it is possible for the disc jockey to generate a sound effect extemporaneously according to his/her own sense. Furthermore, this sound-processing apparatus is capable of generating various sound effects that fit the atmosphere of the location or a sound that is output from an information-reproduction apparatus such as a CD player, and that correspond to the beat of the sound to be modulated, so it is possible for listeners to enjoy stimulating sound effects that correspond to the beat of the sound to be modulated.

Moreover, since it is not necessary for the disc jockey to worry about the sound effect becoming out of phase from the beat, it is possible for the disc jockey to have more time to prepare for generating the next sound effect or selecting the next sound to be played.

Furthermore, with this invention, a time delay is generated for the sound to be modulated based on the sound level detected by the signal-conversion unit 8. Also, the adding unit 11 adds the time-delayed sound to be modulated to the sound to be modulated for which a time delay is not generated. The time delay is generated based on the sound level, so the sound to be modulated is added to the time-delayed sound to be modulated at fixed intervals that are synchronized with the beat of the sound to be modulated. The amount of time delay changes according to the sound level, so the high-frequency component of the added output sound is enhanced and a sound having a unique swelling effect is output.

With this construction, it is possible to generate a sound whose high-frequency component is enhanced and that has one or more swells that are synchronized with the beat of the sound to be modulated. As a result, it is possible to enjoy sound effects having various time differences for one beat.

Also, it is possible for the disc jockey to extemporaneously generate a sound effect by way of a time-difference-setting unit according to his/her own sense. Moreover, this sound-processing apparatus is capable of generating various sound effects that fit the atmosphere of the location or a sound that is output from an information-reproduction apparatus such as a CD player, and that correspond with the beat of the sound to be modulated, so it is possible for listeners to enjoy stimulating sound effects that correspond to the beat of the sound to be modulated.

Moreover, since it is not necessary for the disc jockey to worry about the sound effect become out of phase from the beat, it is possible for the disc jockey to spend more time in preparing to generate the next sound effect or to select the next sound to be played.

Furthermore, with this invention, a phase delay is generated for the sound to be modulated based on the sound level detected by the signal-conversion unit 8. Also, the adding unit 11 adds the phase-delayed sound to be modulated to the sound to be modulated for which a phase delay is not generated. The phase delay is generated based on the sound level, so the sound to be modulated is added to the phase-delayed sound to be modulated at fixed intervals that are synchronized with the beat of the sound to be modulated. The amount of phase delay changes according to the sound level, so the high-frequency component of the added output sound is enhanced and a sound having a unique swelling effect is output.

Therefore, with this sound-processing apparatus, it is possible to generate a sound whose high-frequency component is enhanced and that has one or more swells that are synchronized with the beat of the sound to be modulated. As a result, it is possible to enjoy sound effects having various time differences for one beat.

Furthermore, with this invention, the passable frequency of a sound to be modulated is changed by specified-frequency-band-passing means based on the sound level detected by the signal-conversion unit 8. Also, the sound to be modulated of which only the specified frequency band was allowed to pass is added to the original sound to be modulated by the adding unit 11. The specified frequency band changes based on the sound level, so the added sound is output as a sound effect having a unique swelling effect from a low sound to high sound.

Therefore, with this sound-processing apparatus, it is possible to generate a sound whose high-frequency component is enhanced and that has one or more swells that are synchronized with the beat of the sound to be modulated. As a result, it is possible to enjoy sound effects having various time differences for one beat.

Also, by storing programs corresponding to the flowcharts shown in FIG. 6, FIG. 9 and FIG. 12 beforehand on a flexible disc or the like, or by storing programs beforehand by way of a network such as the Internet, and then reading and executing those programs by a general-purpose microcomputer, it is possible for that general-purpose microcomputer to function as the CPU of the embodiments of the invention.

The entire disclosure of Japanese Patent Application No. 2004-245512 filed on Aug. 25, 2004 including the specification, claims, drawings and abstract is incorporated herein by reference in its entirety.

What is claimed is:

1. A sound-processing apparatus comprising:

a synchronized-sound-generation device for generating at least one or more new synchronized sound signal that is synchronized with a sound signal to be modulated;

a parameter-detection device for detecting a parameter that indicates an attribute of the generated synchronized sound signal;

a converted-signal-generation device for generating a converted signal based on the detected parameter;

a modulation device for modulating the sound signal based on the generated converted signal; and a time-difference-setting device used for setting a starting time difference between the sound to be modulated and the synchronized sound to be generated; wherein the synchronized-sound-generation device generates the synchronized sound having at least one or more time difference based on at least one or more time difference that is set by the time-difference-setting device, wherein the parameter-detection device detects the beat of the synchronized sound signal, wherein the converted-signal-generation device comprises:

a sound-level-detection device for detecting the sound level of the synchronized sound signal of the detected beat portion; and a detection-sensitivity-setting device for setting the detection sensitivity for the sound-level-detection device; and wherein the modulation device changes modulation of the sound signal to be modulated based on the detected sound level.

2. The sound-processing apparatus according to claim 1, wherein the modulation device comprises:

a time-delay device for delaying the time of the sound to be modulated based on the detected sound level in order to generate a time-delayed signal;

a gain-change device for changing the gain of the time-delayed signal for which the time is delayed;

a first adding device for adding the time-delayed signal, for which the gain is changed, and the sound signal to be modulated, and then feeding back and inputting the added signal to the time-delay device; and a second adding device for adding the time-delayed signal, for which the time is delayed, and the sound signal to be modulated, and then outputting the added signal.

3. The sound-processing apparatus according to claim 1, wherein the modulation device comprises:

a phase-delay device for delaying the phase of the sound to be modulated based on the detected sound level in order to generate a phase-delayed signal;

a gain-change device for changing the gain of the phase-delayed signal for which the phase is delayed;

a first adding device for adding the phase-delayed signal, for which the gain is changed, and the sound signal to be modulated, and then feeding back and inputting the added signal to the phase-delay device; and a second adding device for adding the phase-delayed signal, for which the phase is delayed by the phase-delay device, and the sound signal to be modulated, and then outputting the added signal.

4. The sound-processing apparatus according to claim 1, wherein the modulation unit comprises:

a specified-frequency-band-passing device having at least one or more cutoff frequencies and that changes the value of any one of the cutoff frequencies based on the detected sound level; and an adding device for adding the passed signal that passed through the specified-frequency-band-passing device and the sound signal to be modulated, then feeding back and inputting the added signal to the specified-frequency-band-passing device.

5. A sound-processing method comprising:

a synchronized-sound-generation process of generating at least one or more new synchronized sound signal that is synchronized with a sound signal to be modulated;

a parameter-detection process of detecting a parameter that indicates an attribute of the generated synchronized sound signal;

a converted-signal-generation process of generating a converted signal based on the detected parameter;

a modulation process of modulating the sound signal based on the generated converted signal; and a time-difference-setting process used for setting a starting time difference between the sound to be modulated and the synchronized sound to be generated; wherein the synchronized-sound-generation process generates the synchronized sound having at least one or more time difference based on at least one or more time difference that is set by the time-difference-setting process, wherein the parameter-detection process detects the beat of the synchronized sound signal, wherein the converted-signal-generation process comprises:

a sound-level-detection process of detecting the sound level of the synchronized sound signal of the detected beat portion; and a detection-sensitivity-setting process of setting the detection sensitivity for the sound-level-detection process; and wherein the modulation process changes modulation of the sound signal to be modulated based on the detected sound level.

6. A sound-processing program that makes a computer included in a sound-processing apparatus that modulates a sound to be modulated function as:

a synchronized-sound-generation device for generating at least one or more new synchronized sound signal that is synchronized with a sound signal to be modulated;

a parameter-detection device for detecting a parameter that indicates an attribute of the generated synchronized sound signal;

a converted-signal-generation device for generating a converted signal based on the detected parameter;

a modulation device for modulating the sound signal based on the generated converted signal; and a time-difference-setting device used for setting a starting time difference between the sound to be modulated and the synchronized sound to be generated; wherein the synchronized-sound-generation device generates the synchronized sound having at least one or more time difference based on at least one or more time difference that is set by the time-difference-setting device, wherein the parameter-detection device detects the beat of the synchronized sound signal, wherein the converted-signal-generation device comprises:

a sound-level-detection device for detecting the sound level of the synchronized sound signal of the detected beat portion; and a detection-sensitivity-setting device for setting the detection sensitivity for the sound-level-detection device; and wherein the modulation device changes modulation of the sound signal to be modulated based on the detected sound level.

7. An information-recording medium that can be read by a computer and on which the sound-processing program of claim 6 is recorded.

* * * * *